US006659448B2

(12) United States Patent
Guaraldi et al.

(10) Patent No.: US 6,659,448 B2
(45) Date of Patent: Dec. 9, 2003

(54) ADJUSTABLE SEPARATOR FOR A SHEET SEPARATING DEVICE

(75) Inventors: Glen Alan Guaraldi, Kingston, NH (US); Mehmet Oktay Kaya, Lee, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 18 days.

(21) Appl. No.: 10/016,759

(22) Filed: Oct. 30, 2001

(65) Prior Publication Data

US 2003/0080491 A1 May 1, 2003

(51) Int. Cl.[7] ..... B65H 3/34

(52) U.S. Cl. ..... 271/104; 271/106; 271/166; 271/168; 271/167; 271/134

(58) Field of Search ..... 271/104, 132, 271/134, 112, 106–107, 166–167, 168–169, 170; 270/52.2

(56) References Cited

U.S. PATENT DOCUMENTS 1,068,891 A * 7/1913 Green ..... 271/106
1,920,001 A * 7/1933 Chambers ..... 271/101
2,161,866 A * 6/1939 Huckins ..... 271/104
3,100,110 A * 8/1963 Winkler et al. ..... 271/104
3,586,316 A * 6/1971 Ehlscheid et al. ..... 271/98
3,988,016 A 10/1976 Merker et al. ..... 270/55
4,013,283 A * 3/1977 Tress et al. ..... 271/14
4,116,428 A * 9/1978 Schubert ..... 271/14
4,157,692 A 6/1979 Brocklehurst et al. ... 112/262.3
4,480,826 A * 11/1984 Kaneko ..... 271/103
4,768,770 A * 9/1988 Pessina et al. ..... 271/107
5,535,998 A * 7/1996 Geffert et al. ..... 271/99
6,070,866 A * 6/2000 Wepfer ..... 271/10.11
6,155,554 A * 12/2000 Helm et al. ..... 271/94

* cited by examiner

*Primary Examiner*—Patrick Mackey
(74) *Attorney, Agent, or Firm*—Davidson, Davidson & Kappel, LLC

(57) ABSTRACT

An apparatus for separating flat products from a pile of flat products, the apparatus including a support and at least one separator for separating a product from a pile of products. The separator is movable with respect to the support and includes a curved surface for contacting an edge of the pile so that a contact point between the separator and the edge of the pile can remain fixed despite adjustments to the penetration depth of the separator.

18 Claims, 2 Drawing Sheets

ADJUSTABLE SEPARATOR FOR A SHEET SEPARATING DEVICE

BACKGROUND OF THE INVENTION

The present invention relates generally to apparatus for separating flat products from a pile of flat products, and more particularly to an apparatus for separating flat products from a pile of flat products, the apparatus including adjustable separators supporting the bottom of a pile of flat products.

In the technology of creating books, including booklets, magazines, periodicals, and the like, the use of collating systems is well known. These systems typically have a transporting device on which individual flat products, such as signatures or sheets, are gathered to build a book-block set, which then is finished and bound. Typically, a number of feeders are arranged along the transporting device, each of the hoppers comprising a feeding mechanism for feeding an individual flat product from a pile of signatures onto the transporting device, in order to gradually build up the book-block set or to insert a supplement sheet into a pocket of a pocket feeder or into a newspaper arranged in the pocket. Such feeding mechanisms typically employ a sheet-separating device for separating a sheet or other single flat product from a pile of flat products which is arranged in each hopper. The single flat products are drawn from the pile at its bottom end.

A sheet-separating device of this kind is known, for example, from U.S. Pat. No. 3,988,016. This document describes a high-speed paper inserting apparatus for insertion of supplements into newspapers. The inserts are placed to form a stack and a vacuum gripping member grips the lowermost insert from the stack and carries it to a pair of nip rollers which transport the insert to an opened newspaper. A single sheet requires a different sucker stroke than a 120 page or pre-inserted section. The different sucker motion requirements are due to the way the sheets or sections have to be positioned and controlled for proper singulation. Generally, the bottom of the stack is supported by a platform, a so-called signature table having a recess for allowing a sucker to draw a single product from the lowermost end of the pile of products. When the sucker does not contact the pile of products, the pile is supported by a movable hook, as shown in U.S. Pat. No. 4,157,692.

SUMMARY OF THE INVENTION

It is an object of the present invention to provide a sheet-separating device with improved separation of the lowermost product of the pile of products.

Commonly-owned U.S. Pat. No. 09/939,428 filed on Aug. 24, 2001 and claiming priority to U.S. Provisional Patent Application No. 60/226,247 filed Feb. 2, 2001, discloses using a plurality of movable needles for selectively supporting the bottom of a stack of signatures, the needles moving in and out of the stack about a pivot point. The penetration depth of the needles is adjustable. U.S. Pat. No. 09/939,428 is hereby incorporated by reference herein.

When the penetration depth of the needles of the '428 device is adjusted, the contact point of the needles with an edge of the stack can vary, leading to separation problems.

The present invention provides an apparatus for separating flat products from a pile of flat products, the apparatus including a support and at least one separator for separating a product from a pile of products, the separator being movable with respect to the support, the separator including a curved surface for contacting an edge of the pile.

The curved surface permits a penetration depth of the separator to be set by rotation without significantly altering the contact position of the separator and the edge of the pile, which can improve separation.

Preferably, the curved surface defines an arc of a circle. Most preferably, the separator rotates about an axis, and the arc has a constant radius about the axis.

An actuating device can move the separator.

A plurality of separators, for example four or six, spaced along the edge of the pile preferably is provided, the separators being fixed to a rotating block. The rotating block rotates about the axis, and is actuated by the actuating device.

The axis is preferably located below the contact position, so that the curved surface is convex.

The present invention also provides a method for separating a bottom product from a pile of products comprising the steps of:

rotating a separator into the pile, the separator defining a penetration depth; and adjusting the penetration depth without altering a contact point between an edge of the pile and the separator.

Preferably, the separator includes a curved surface. The curved surface preferably defines an arc of a circle. The separator preferably rotates about an axis, and the arc preferably is defined by a constant radius about the axis. The axis preferably is below the separator so that the curved surface is convex.

The present invention also a method for separating flat products from a pile of flat products comprising the steps of moving at least one separator for separating a product from a pile of products with respect to a support, the separator including a curved surface for contacting an edge of the pile.

Preferably, the curved surface defines an arc of a circle about an axis, the at least separator moving by rotation about the axis.

BRIEF DESCRIPTION OF THE DRAWINGS

The present invention is elaborated upon below with reference a preferred embodiment disclosed in the accompanying drawings, in which.

DETAILED DESCRIPTION

Figure 1:
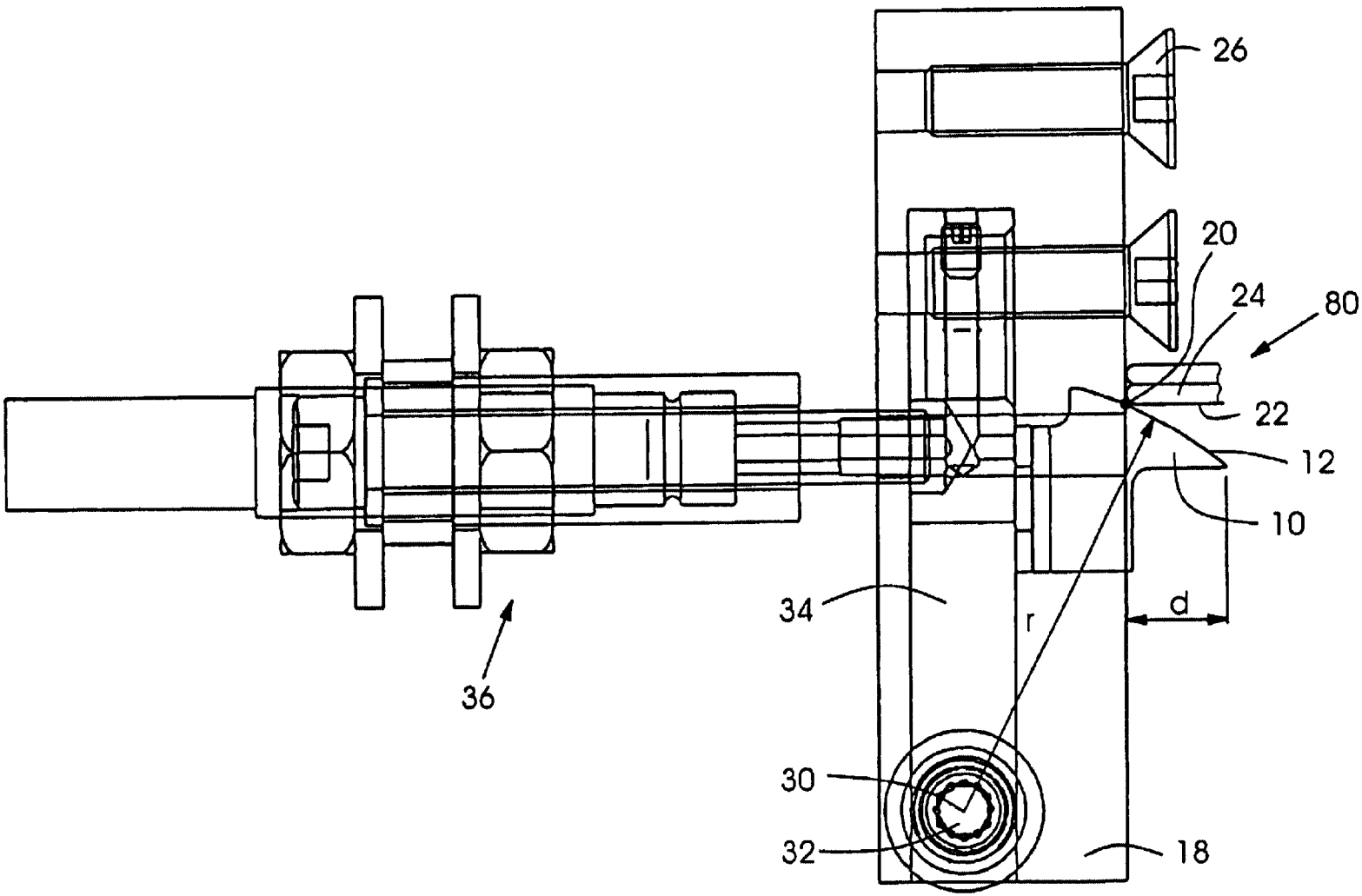
FIG. 1 shows a schematic side view of a preferred embodiment of the sheet separating device.
Figure 2:
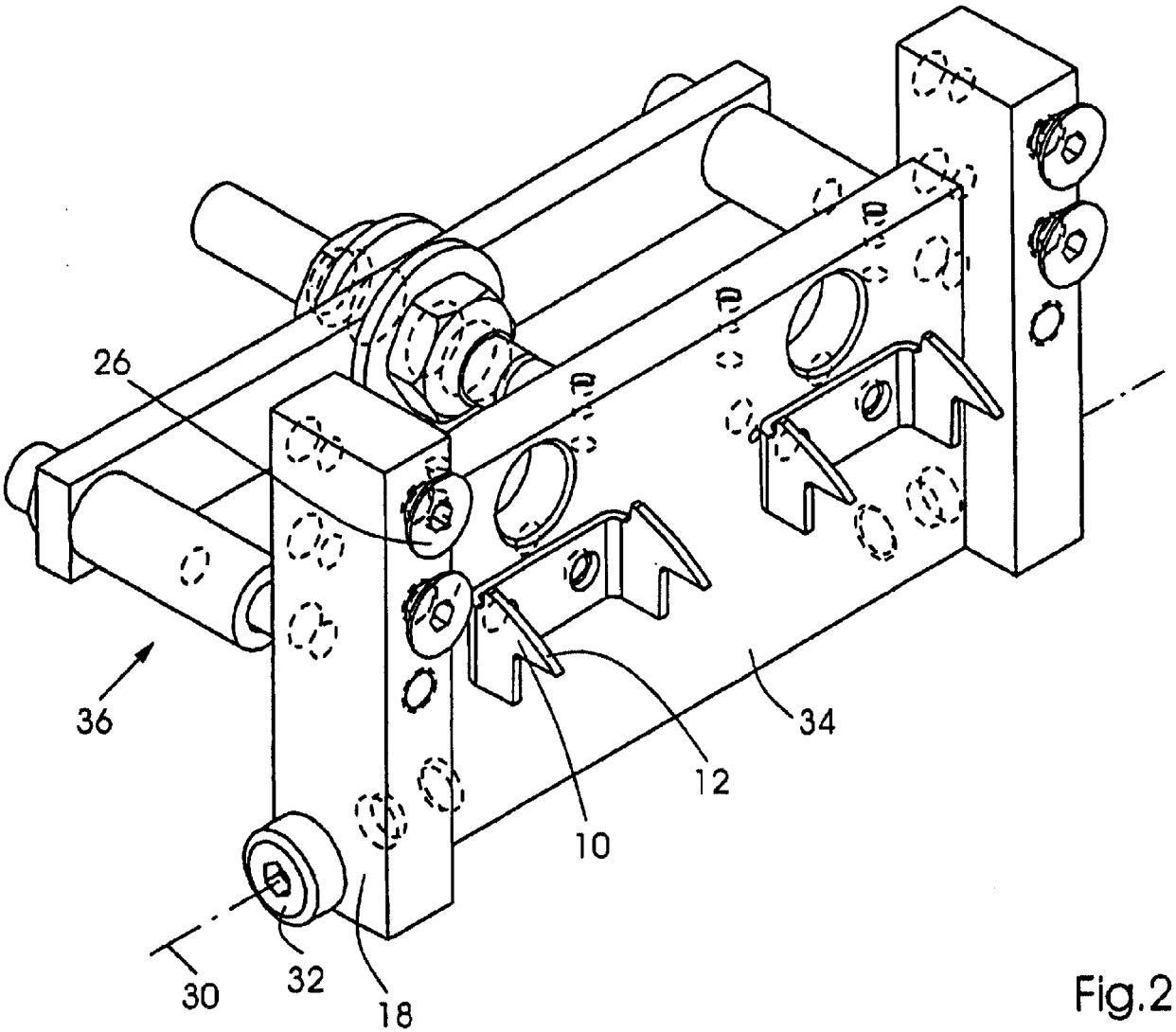
FIG. 2 shows a perspective top front view of the sheet separating device of FIG. 1, which can be attached to a hopper.

FIGS. 1 and 2 show the sheet separating device according to a preferred embodiment. The device may be attached to a hopper by bolts 26, so that support 18 (or a part of the hopper such as a face plate connected to support 18) defines a front support for a stack of flat products 80. Stack of flat products 80, for example signatures, can lie flat on a signature table 22 of the hopper, with an edge of bottommost product 24 defining an edge or contact point 20 of stack 80.

A lift hook and suckers may aid in the removal of the signatures. During the transition between closing and openings of the lift hook and sucker, the signature stack is supported by separators 10 selectively protruding through an opening in a front guide of the hopper. Preferably, there are multiple separators 10, for example four or six evenly spaced along the edge of the stack. The separators 10 may be fixed by bolts to a rotating block 34, which rotates about an axis 30 defined by a pivot 32 supported in support 18, which is fixed with respect to the hopper. An actuating device 36 connects to the block 34 above the pivot 32 so as to permit rotation of the block 34 about axis 30.

Separators 10 on block 34 thus can rotate in an out of the stack 80 so as to achieve a protrusion depth d. Separators 10 have a curved surface 12 for interacting with edge 20, with the curved surface 12 forming an arc having a constant radius r with respect to axis 30. The depth d needles 50 protrude through the face plate is important, because if the needles protrude too far, the sucker cannot effectively remove the signature 22, and if the needles protrude too little, they will not effectively support the signature.

The protrusion depth d of the separators can be set by setting the stroke length of actuating device 36, which may include a piston.

Due to the curved surface 12, the intersection point 20 of the top level of the signature table 22 and the support 18 (or if support 18 is not the front plate, the front plate of the hopper) remains the same, even if the protrusion depth d is adjusted.

The axis 30 preferably is below the table 22, so that a convex surface 12 results. However, a pivot point above the table 22 could also be possible.

"Support" as defined herein may be any part of the sheet separating device stationary with respect to the hopper or may be a part of the hopper itself. "Sheet" as defined herein can be any flat product including signatures.

What is claimed is:

1. An apparatus for separating flat products from a pile of flat products, the apparatus comprising:

a support; and a plurality of separators for separating a product from a pile of products, the separators being movable with respect to the support, the separators including a curved surface for contacting an edge of the pile; and a rotating block rotating about an axis, the separators being fixed to the block.

2. The apparatus as recited in claim 1 wherein the curved surface defines an arc of a circle.

3. The apparatus as recited in claim 1 further comprising an actuating device rotating the axis.

4. The apparatus as recited in claim 3 wherein the axis is located below the contact position and the curved surface is convex.

5. The apparatus as recited in claim 1 wherein the plurality of separators are spaced along the edge of the pile.

6. A method for separating a bottom product from a pile of products comprising the steps of:

rotating at least one separator into the pile, the separator defining a penetration depth; and adjusting the penetration depth without altering a contact point between an edge of the pile and the separator.

7. The method as recited in claim 6 wherein the separator includes a curved surface.

8. The method as recited in claim 7 wherein the curved surface defines an arc of a circle.

9. The method as recited in claim 8 wherein the separator rotates about an axis, and the arc is defined by a constant radius about the axis.

10. The method as recited in claim 9 wherein the axis is below the separator and the curved surface is convex.

11. The method as recited in claim 6 wherein the at least one separator include a plurality of separators.

12. The method as recited in claim 6 wherein the separator separates a bottommost product.

13. An apparatus for separating flat products from a pile of flat products, the apparatus comprising:

a support; and at least one separator for separating a product from a pile of products, the separators being movable with respect to the support, the separators including a curved surface for contacting an edge of the pile, the curved surface defining an arc, wherein the separator rotates about an axis, and the arc has a constant radius about the axis.

14. The apparatus as recited in claim 13 wherein the at least one separator includes a plurality of separators attached to a rotating block.

15. A method for separating flat products from a pile of flat products comprising the step of moving at least one separator for separating a product from a pile of products with respect to a support, the separator including a curved surface for contacting an edge of the pile, wherein the curved surface defines an arc of a circle about an axis, the at least separator moving by rotation about the axis.

16. The method as recited in claim 15 wherein the at least one separator includes a plurality of separators attached to a rotating block.

17. A method for separating flat products from a pile of flat products comprising the step of moving a plurality of separators for separating a product from a pile of products with respect to a support, the separators including a curved surface for contacting an edge of the pile, the plurality of separators being fixed to a block rotating about an axis.

18. The method as recited in claim 17 wherein the separator separates a bottommost pile.

* * * * *

UNITED STATES PATENT AND TRADEMARK OFFICE

CERTIFICATE OF CORRECTION

PATENT NO. : 6,659,448 B2
DATED : December 9, 2003
INVENTOR(S) : Glenn Alan Guaraldi et al.

It is certified that error appears in the above-identified patent and that said Letters Patent is hereby corrected as shown below:

Title page,
Item [75], Inventors, please delete "Glen Alan Guaraldi," and replace with -- Glenn Alan Guaraldi --.

Signed and Sealed this

Fourth Day of May, 2004

JON W. DUDAS
*Acting Director of the United States Patent and Trademark Office*